US005094197A

United States Patent [19]

Rosa

[11] Patent Number: 5,094,197

[45] Date of Patent: Mar. 10, 1992

[54] TIMING SYSTEM, PARTICULARLY FOR AN INTERNAL COMBUSTION ENGINE WITH A NUMBER OF VALVES PER CYCLINDER

[75] Inventor: Riccardo Rosa, Maranello, Italy

[73] Assignee: Ferrari S.p.A., Modena, Italy

[21] Appl. No.: 663,015

[22] Filed: Mar. 1, 1991

[51] Int. Cl.[5] ..... F01L 1/14; F01L 1/26

[52] U.S. Cl. ..... 123/90.27; 123/90.22; 123/308

[58] Field of Search ..... 123/90.22, 90.27, 90.28, 123/90.48, 308

[56] References Cited

U.S. PATENT DOCUMENTS

| | | | |
|---|---|---|---|
| 4,615,309 | 10/1986 | Yoshikawa | 123/90.27 |
| 4,915,065 | 4/1990 | Yamada | 123/90.27 |
| 5,016,592 | 5/1991 | Onodera | 123/308 |

FOREIGN PATENT DOCUMENTS

| | | | |
|---|---|---|---|
| 0262250 | 4/1988 | European Pat. Off. . | |
| 0324092 | 7/1989 | European Pat. Off. . | |
| 0340834 | 11/1989 | European Pat. Off. . | |
| 3524622 | 1/1987 | Fed. Rep. of Germany | 123/90.27 |
| 238106 | 9/1990 | Japan | 123/90.48 |
| 0296125 | 8/1928 | United Kingdom . | |

*Primary Examiner*—E. Rollins Cross
*Assistant Examiner*—Weilun Lo
*Attorney, Agent, or Firm*—Shlesinger Arkwright & Garvey

[57] ABSTRACT

A timing system for controlling, via a single overhead camshaft, three or more valves of an internal combustion engine cylinder, each valve presenting a tappet located between each valve stem and a respective cam on the camshaft. The tappet axes are shifted laterally on alternate opposite sides in relation to the axes of the respective valve stems, so as to define a first predetermined eccentricity between the valve stem axes and the axis of each tappet. Moreover, the axis of each tappet is arranged eccentrically in relation to the rotation axis of the camshaft on the valve stem side, so as to define a second predetermined eccentricity in relation to the camshaft axis.

6 Claims, 2 Drawing Sheets

TIMING SYSTEM, PARTICULARLY FOR AN INTERNAL COMBUSTION ENGINE WITH A NUMBER OF VALVES PER CYCLINDER

BACKGROUND OF THE INVENTION

The present invention relates to a timing system for regulating, via respective camshaft-controlled valves, fluid input or output to/from one or more cylinders of an engine and/or machine. In particular, the present invention relates to an overhead camshaft timing system for an internal combustion engine featuring a number of valves, e.g. five, per cylinder.

To improve the volumetric efficiency of internal combustion engines, particularly high-performance engines of sports cars or so-called touring cars, the common design practice is to provide timing systems which, instead of the usual two valves (supply and exhaust) per cylinder, feature for example four (two supply and two exhaust) or five (three supply and two exhaust) valves per cylinder. The latter type in particular involves serious design problems in terms of valve control and/or arrangement of the valves to prevent interference, particularly between the tappets of the three supply valves. To overcome this problem, U.S. Pat. No. 4,615,309 provides for a spread arrangement of the supply valves, the middle one being arranged obliquely in relation to the two lateral valves, thus enabling all three to be controlled by a single camshaft, and for using tappets with smaller than normal diameter caps, in the example shown, smaller than the caps on the exhaust valves.

Such a solution, however, still involves a number of drawbacks. Firstly, the supply valve springs are difficult, when not impossible, to seat inside the respective tappet caps, thus resulting in reduced compactness. And, secondly, the small diameter caps, particularly in the presence of valves inclined in relation to the camshaft, and therefore in the presence of possible lateral thrust on the tappets, may result in increased contact pressure between the caps and the cap guides on the cylinder head, thus resulting in impairment of the lubricating oil film and/or greater wear on moving parts.

SUMMARY OF THE INVENTION

The aim of the present invention is to provide a timing system, particularly for high-performance internal combustion engines, designed to overcome the aforementioned drawbacks, i.e. which is both compact and straightforward to produce, and enables the obtainment of valve ports of as large a size as possible.

With this aim in view, according to the present invention, there is provided a timing system, particularly for an internal combustion engine, whereby a camshaft controls, against the action of elastic means, the translation of respective stems of a number of adjacent service valves for regulating the input or output of a fluid from a respective cylinder; each said valve being controlled by a respective cam of said camshaft via the interposition of a respective tappet; characterised by the fact that the respective axes of said valve stems are arranged eccentrically and on alternate opposite sides in relation to the axis of the respective tappet, so as to define a first predetermined eccentricity between the axis of each tappet and the axis of the corresponding valve stem.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
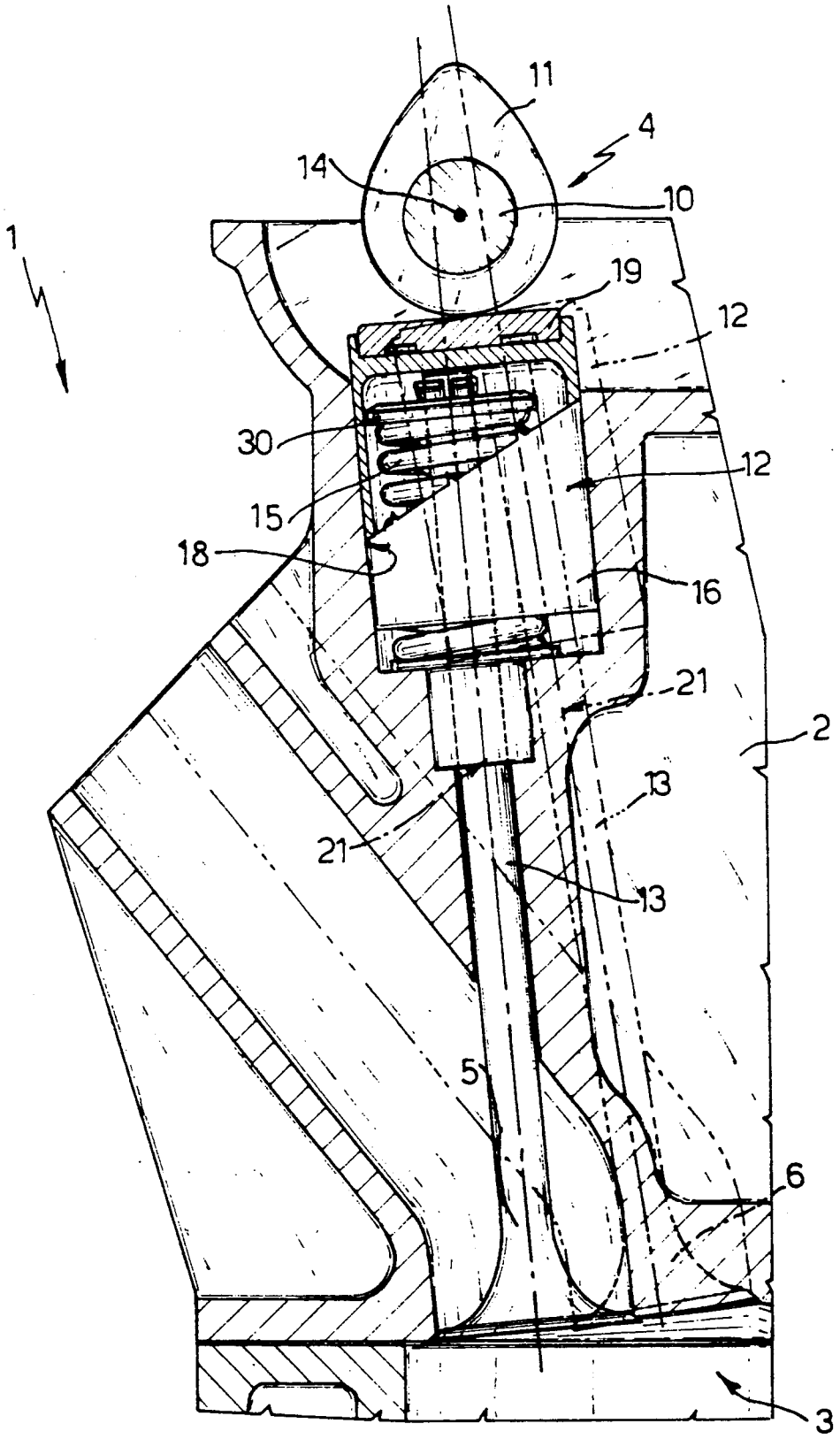
FIG. 1 shows a lateral section of an internal combustion engine featuring a timing system in accordance with the present invention.
Figure 2:
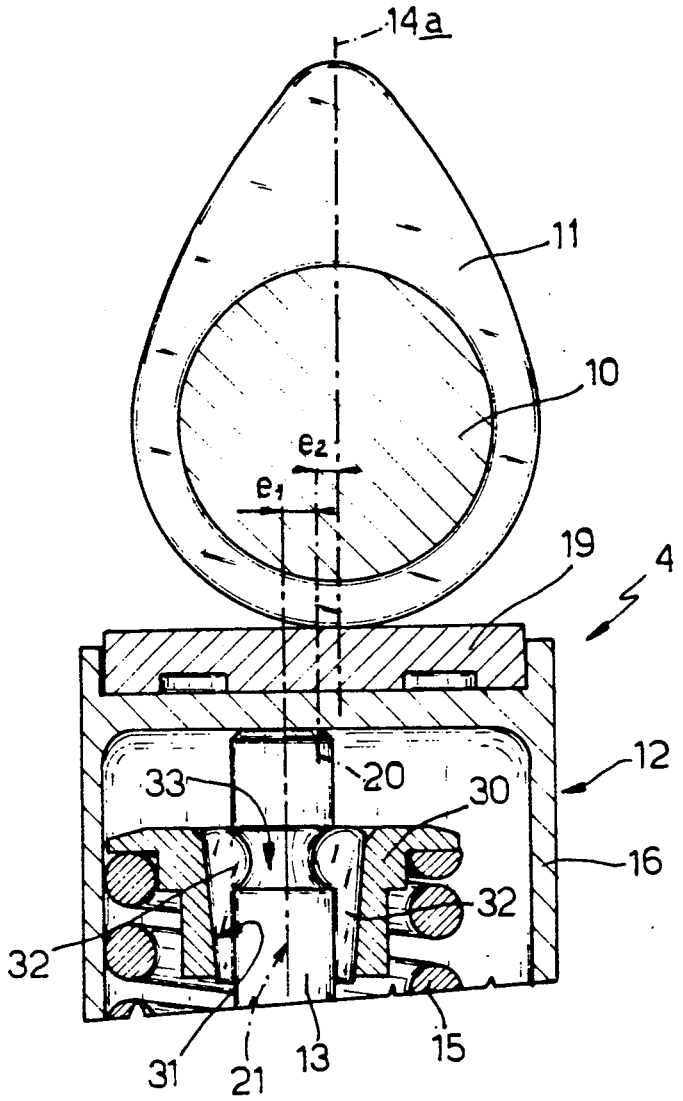
FIG. 2 shows a larger-scale view of a detail in FIG. 2.
Figure 3:
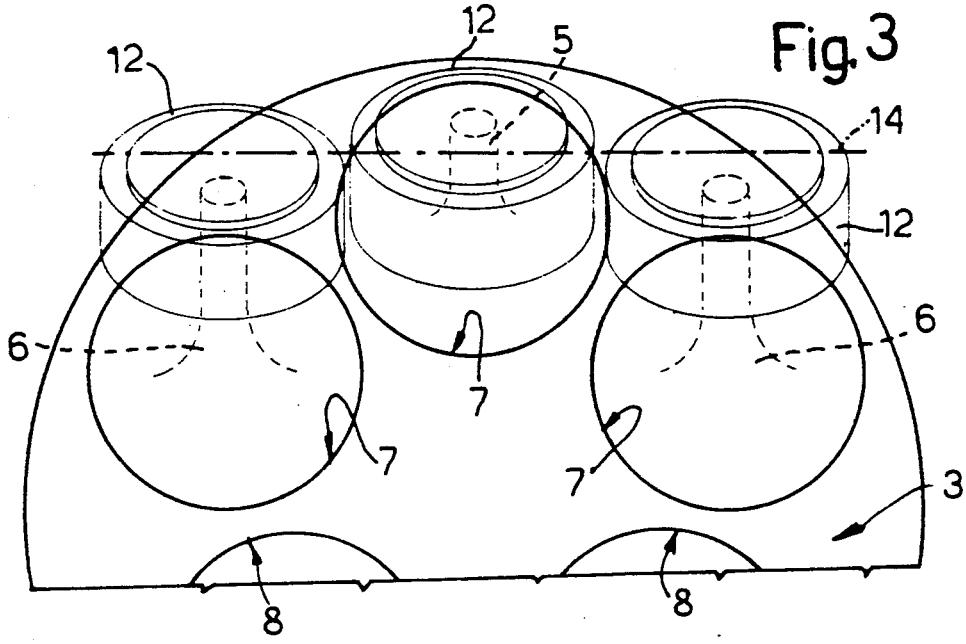
FIG. 3 shows a schematic layout in perspective of a number of components on the timing system according to the present invention.

Number 1 in FIGS. 1 to 3 indicates a known internal combustion engine of which is illustrated, for the sake of simplicity, only the top portion comprising a cylinder head 2 and, underneath, a single cylinder 3 defining, together with cylinder head 2, one of the combustion chambers of engine 1. The other combustion chambers defined by any other cylinders 3 of engine 1 are not shown. Engine 1 presents a timing system indicated as a whole by 4 and comprising, in the non-limiting example shown, five service valves for each cylinder 3: three adjacent supply valves 5 and 6; and two adjacent known exhaust valves (not shown). All the above valves are mushroom types for opening/closing respective intake ports 7 and exhaust ports 8 of cylinder 3. Said ports are formed in a ring on cylinder head 2, on top of the combustion chamber defined by cylinder head 2 and respective cylinder 3, and are arranged substantially in the form of a pentagon.

Timing system 4 also comprises a respective camshaft 10 for simultaneously controlling all the valves 5 and 6 of all the cylinders 3 on engine 1; and a similar known camshaft (not shown) for controlling in known manner the valves of exhaust ports 8 of all the cylinders 3 on engine 1. For each valve 5 and 6, shaft 10 comprises a respective control cam 11 of predetermined shape, for controlling translation of a respective valve stem 13 via the interposition of a respective known tappet 12 and against the action of respective elastic means 15. According to the non-limiting example shown, timing system 4 according to the present invention presents an overhead camshaft arrangement, i.e. wherein cams 11 of camshaft 10 cooperate directly with tappets 12, camshaft 10 being arranged so as to turn about an axis 14 (indicated in FIG. 1 by a point defining its projection) corresponding directly with ports 7. Tappets 12 may be mechanical types with no slack adjustment, as in the non-limiting example shown, or any known hydraulic type with automatic slack takeup. Whichever the case, each tappet 12 comprises a cylindrical cap 16 housed in axially sliding manner inside a guide seat 18 formed in cylinder head 2; and a plate 19 on top of cap 16 and between this and respective cam 11. Cylindrical cap 16 defines the outer body of each tappet 12, the axis of which is therefore defined by the longitudinal axis of symmetry 20 of cap 16 (FIG. 2).

According to the present invention, each stem 13 of valves 5 and 6 presents its longitudinal axis of symmetry 21 offset in relation to axis 20 of respective tappet 12. In particular, axes 21 are arranged eccentrically on alternate opposite sides of axis 20 of respective tappet 12, so as to define a first predetermined eccentricity el (FIG. 2) between axis 20 of each tappet 12 and axis 21 of respective valve stem 13. Moreover, axes 20 of tappets 12 are shifted laterally on alternate opposite sides in relation to the axis of rotation 14 (the transverse position of which is shown by perpendicular line 14*a* in FIG. 2) of camshaft 10 on the side of respective valve stems 13, so as to define a second predetermined eccentricity $e_2$ between axis 14 of camshaft 10 and axis 20 of each tappet 12.

According to a further characteristic of the present invention, valve 5, which is located between said two valves 6, is also inclined in relation to valves 6, so that axis 21 of stem 13 of valve 5 diverges towards respective cylinder 3 in relation to those of valves 6 (FIG. 1). By combining the above two characteristics, axes 21 of stems 13 of all three valves 5, 6, when projected in a transverse plane in relation to axis 14, converge at a point (not shown) some distance from and over axis 14 of camshaft 10. Moreover, eccentricity $e_2$ and the size of respective plate 19 are so selected that each cam 11 of camshaft 10 cooperates exclusively with, and exclusively within the horizontal confines of, plate 19 of respective tappet 12. This provides for limiting any localized wear exclusively to plate 19, which is replaceable, as well as for minimising lateral thrust on guides 18, despite off-centering of the axis along which the thrust of cams 11 is applied (axis 14*a*) and axis 20 of respective tappet 12.

Said elastic contrasting means of valves 5 and 6 comprise respective helical springs 15 wound coaxially about stems 13 and housed inside the top of tappets 12, in the example shown, inside caps 16, together with a respective shoulder plate 30 for and integral with each valve stem 13. Via a conical surface 31 flaring towards respective plate 19, each shoulder plate 30 cooperates with a pair of known cotters 32 secured axially integral with stem 13 via engagement inside a groove 33 on the same. The end of stem 13 cooperates with cap 16, while, opposite tappet 12, spring 15 rests on the bottom wall of guide seat 18, thus providing for a continuous control mechanism for controlling translation of valves 5 and 6 along the axis of stems 13.

The advantages of the present invention will be clear from the foregoing description. The off-centered arrangement of valve stems 13 in relation to the axis of tappets 12 and of tappets 12 in relation to the axis of rotation of camshaft 10, and the diverging arrangement of central supply valve 5 and the two lateral supply valves 6 provide for obtaining a five-valve timing system featuring three large, widely spaced supply ports (for adequate cooling and safeguarding the cylinder head) despite the three valves being controlled by a single, and what is more, overhead camshaft. This therefore results in a highly efficient, high-performance internal combustion engine timing system, which is also highly compact. What is more, off-centering of the various valve control components may be fairly small, thus minimising lateral thrust on the guide surfaces of tappets 12, which, more importantly, is predictable and, if necessary, may be counteracted at the design stage. On engines with known timing systems, on the other hand, wherein spacing of the intake ports depends solely on the degree of inclination of the valves, in-service lateral thrust may be unpredictable and, therefore, far more difficult to counteract.

To those skilled in the art it will be clear that changes may be made to the system as described and illustrated herein without, however, departing from the scope of the present invention. For example, a similar timing system to the one described herein may provide for indirect valve control via rocker arms, in which case, using rocker arms of different lengths, the control thrust on the tappets may be applied axially.

I claim:

1. A timing system, particularly for an internal combustion engine, whereby a camshaft controls, against the action of elastic means, the translation of respective stems of a number of adjacent service valves for regulating the input or output of a fluid from a respective cylinder; each said valve being controlled by a respective cam of said camshaft via the interposition of a respective tappet; characterized by the fact that the respective axes of said valve stems are arranged eccentrically and on alternate opposite sides in relation to the axis of the respective tappet, so as to define a first predetermined eccentricity between the axis of each tappet and the axis of the corresponding valve stem, wherein; the cams of said camshaft cooperate directly with the respective said valve tappets according to an overhead camshaft arrangement; the axes of said tappets being shifted laterally on alternate opposite sides of the rotation axis of said camshaft on the valve stem side, so as to define a second predetermined eccentricity between the axis of said camshaft and the axis of each said tappet.

2. A timing system as claimed in claim 1, characterized by the fact that it comprises three supply valves for each said cylinder; said three valves being controlled simultaneously by said camshaft, and one of said three valves being located between and inclined in relation to the other two, so that the stem axis of said central valve diverges towards the respective said cylinder and in relation to the stem axes of the other two valves.

3. A timing system as claimed in claim 2, characterized by the fact that the stem axes of said three valves converge at a point some distance from and over the axis of said camshaft.

4. A timing system as claimed in claim 1, characterized by the fact that said tappets are mechanical, each comprising a cylindrical cap cooperating in sliding manner with a guide seat formed in the cylinder head of said respective cylinder; and a plate on top of said cap; said second eccentricity and the size of said plate being so selected that the respective cam of said camshaft cooperates exclusively with and within the confines of said plate.

5. A timing system as claimed in claim 1, characterized by the fact that said elastic means comprise respective helical springs wound about said valve stems and housed at least partially inside said tappets together with a respective shoulder plate for and integral with each said valve stem.

6. A timing system as claimed in claim 5, characterized by the fact that said shoulder plate is secured integral with said respective valve stem via a pair of cotters cooperating with a conical inner surface of said plate and a respective groove on said valve stem.

* * * * *